US005733845A

United States Patent [19]

Brust et al.

[11] Patent Number: 5,733,845

[45] Date of Patent: Mar. 31, 1998

[54] BACKING LAYER FOR COMPOSITE THERMAL DYE TRANSFER ID CARD STOCK

[75] Inventors: David P. Brust, Rochester; Thomas Carl Reiter, Hilton; Peter P. Soscia, Geneseo, all of N.Y.

[73] Assignee: Eastman Kodak Company, Rochester, N.Y.

[21] Appl. No.: 688,884

[22] Filed: Jul. 31, 1996

[51] Int. Cl.[6] ..... B41M 5/035; B41M 5/38

[52] U.S. Cl. ..... 503/227; 428/195; 428/323; 428/480; 428/500; 428/522; 428/910; 428/913; 428/914

[58] Field of Search ..... 8/471; 428/195, 428/323, 480, 500, 522, 910, 913, 914; 503/227

[56] References Cited

U.S. PATENT DOCUMENTS 5,198,408 3/1993 Martin ..... 503/227

*Primary Examiner*—Bruce H. Hess
*Attorney, Agent, or Firm*—Harold E. Cole

[57] ABSTRACT

An identification card stock comprising a polymeric core substrate having on at least one side thereof the following layers in order: a hydrophobic antistatic layer, an oriented polymeric film, and an image-receiving layer; and process of using same.

19 Claims, No Drawings

BACKING LAYER FOR COMPOSITE THERMAL DYE TRANSFER ID CARD STOCK

This invention relates to a composite thermal dye transfer identification (ID) card stock, and more particularly to a backing layer for a laminated polyester ID card stock having improved durability and process of using same.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

The use of ID cards has become widespread, especially for driver's licenses, national ID cards, bank and other authority cards, for example. Security is important for such cards, and an important security feature of such cards is the use of a continuous tone color photograph printed in the same layer along with other personal, variable data. This type of information can be rapidly and conveniently placed onto an ID card by use of an electronic camera, a computer, and a computer-controlled digital printer. For example, a video camera or a digital still camera can be used to capture a person's image and a computer can record the corresponding personal, variable data. The image and data can then be printed onto an ID card stock material by a computer-controlled thermal dye transfer printer using the apparatus described in U.S. Pat. No. 4,621,271 referred to above.

The convenience and rapid access of electronically-generated ID cards makes desirable an ID card stock pre-cut to the proper size, readily transportable through a printer, and capable of exiting the printing hardware in the forth of a finished card. Off-line lamination after printing and die cutting to size after lamination are undesirable because of the manual labor and time required. A pre-cut ID card which can be printed as is in a thermal printer is known as a "direct printing card".

Poly(vinyl chloride) (PVC) and/or poly(vinyl chloride/acetate), polyesters, polyethylenes and polycarbonates are known for use as ID card materials. PVC-based cards have been the most widely used, but such cards have a short lifetime of only one to two years due to the marginal physical properties of PVC. PVC is also known to readily absorb plasticizers from other objects thereby further degrading its physical properties. Furthermore, PVC-based cards have also shown a tendency to stick to thermal dye-donors during printing at high densities such that on separation from the card, the dye layer of the dye-donor delaminates and sticks to the card.

The use of an antistatic or electroconductive layer when coating materials onto polyester substrates at high speeds is desirable to avoid static charge build-up on the support. Avoiding charge accumulation aids conveyance of the coated material, reduces the occurrence of coating imperfections and, in the case of coating from organic solvents, prevents explosions of air-solvent vapor mixtures in dryers induced by static electricity discharge. An antistatic layer is also useful for reducing the attraction of dust to the various coatings applied. For example, dust on the receiver surface can produce image dropouts in thermal dye transfer printing or interfere with gluing of the various laminations of an ID card.

Co-pending U.S. application Ser. No. 08/688,975 of Reiter, Soscia and Brust filed of even date herewith and entitled, "Composite Thermal Dye Transfer ID Card Stock," relates to a laminated ID card stock for use in a thermal dye transfer process. It is an object of this invention to provide an antistatic layer useful for that ID card stock.

U.S. Pat. No. 5,198,408 relates to the use of a binder of poly(vinyl alcohol) and poly(ethylene oxide) containing an anionic surfactant and potassium chloride as an antistatic backing layer for a thermal dye transfer receiver element. While this antistatic backing layer has been useful for its intended purpose, there is a problem with this antistatic backing layer when it is used in a laminated ID card stock such as that described in the copending U.S. application Ser. No. 08/688,975 referenced above. In particular, such antistatic backing layers were found to adhere ineffectively to organic solvent-coated adhesives that are activated by heat and pressure used to laminate the structure. These antistatic coatings are hydrophilic or even hygroscopic because of the use of inorganic salts, ionic surfactants, or some charged polymeric species in a hydrophilic binder.

It is an object of this invention to provide a composite ID card stock and process of using same which has an effective antistatic backing layer which will adhere to a polymeric core substrate.

This and other objects am achieved in accordance with this invention which comprises an identification card stock comprising a polymeric core substrate having on at least one side thereof the following layers in order: a hydrophobic antistatic layer, an oriented polymeric film, and an image-receiving layer.

In a preferred embodiment of the invention, an adhesive layer and a hydrophobic overcoat layer are located between the polymeric core substrate and the hydrophobic antistatic layer, the adhesive layer being located on the polymeric core substrate.

The hydrophobic antistatic layer used in this invention is electroconductive, is capable of being glued by adhesives if used in a lamination process, is transparent and colorless, and adheres well to polymeric films. This antistatic backing layer also is not affected unfavorably by heat during gluing or application of a laminate to the printed card.

The ID card structure of the invention is readily suited to making a direct pre-cut card with improved physical properties as compared to PVC-based cards. The ID card stock of the invention provides improved flexural durability over an extended period of time vs. PVC, while retaining good stiffness and impact strength. The ID card material can have layers specifically adapted for thermal printing on both front and back sides, if desked. The card also has separate sites on the polymeric core for printing non-varying information using printing methods other than thermal transfer. The invention also allows one to make use of dye-recieving layers which function well with dye-donors designed to give high maximum density at very short line times without the dye-donor sticking problem encountered with prior art ID cards.

Pro-cut ID card stock can be easily produced by conventional methods using the above-described composite film structure in the conventional shape, size, e.g., 54.5 mm×86 mm, and having a thickness of about 0.8 mm. A pre-cut card stock is one which is made to the card size specifications before printing and exits the printer system without any further trimming or cutting required. An overcoat laminate may be applied after printing if desired.

The thickness of both the polymeric core substrate and oriented polymeric film is variable, but the overall thickness is usually in the range of 685 to 838 μm (27–33 mils). The outer surfaces of the ID card stock can be thermally printed with dye images or text. Optionally, non-varying information, such as lines, line segments, dots, letters, characters, logos, guilloches, etc., can be printed on the polymeric core substrate by non-thermal dye transfer methods such as flexo or offset printing before attaching the polymeric core substrate to the oriented polymeric film or films carrying the external dye-receiving layer or layers.

The composite ID card stock of the invention can also be readily milled for placement of a memory chip. Alternatively, the polymeric core substrate and an oriented polymeric film can be pre-punched before attaching to provide a suitable site for a memory chip.

The polymeric core substrate employed in the invention can comprise, for example, an amorphous polyester, a biaxially-oriented polyester, poly(vinyl chloride), copolymers of poly(vinyl chloride) with the latter constituting more than 50 mole % of the copolymer, polypropylene, and polypropylene copolymers. In a preferred embodiment of the invention, the polymeric core substrate is an amorphous polyester such as EASTAR® PETG 6763, a copolyester from Eastman Chemical Products Company, that is believed to comprise 16 weight % cyclohexanedimethanol, 34 weight % ethylene glycol, and 50 weight % terephthalic acid, and which has a Tg of 81° C. The polymeric core substrate may also be a composite laminate, such as a laminate of the above materials, if desired. The thickness of the polymeric core substrate can be, for example, from 127 to 787 μm (5–31 mils).

The polymeric core substrate may also include pigments for opacification, such as white pigments, e.g., titanium dioxide, barium sulfate, calcium sulfate, calcium carbonate, zinc oxide, magnesium carbonate, silica, talc, alumina and clay. Suitable pigments may be homogeneous and consist essentially of a single compound such as titanium dioxide or barium sulfate alone. Alternatively, a mixture of materials or compounds can be used along with an additional modifying component such as a soap, surfactant, coupling agent or other modifier to promote or alter the degree to which the pigment is compatible with the substrate polymer.

In general, any pigment employed in the polymeric core substrate has an average particle size of from 0.1 to 1.0 μm, preferably from 0.2 to 0.75 μm. The amount of pigment that is incorporated is generally between about 5% and 50% by weight, preferably about 15 to about 20%, based on the weight of the core polymer.

The polymeric core substrate can be formed by conventional methods such as coating, lamination, co-extrusion and hot-melt extrusion. A preferred method comprises heating a pigmented, amorphous polyester to a temperature above its melting point and continuously melt extruding the material in sheet form through a slot die onto a chilled casting drum, after which it solidifies. The amorphous, opaque sheet may then be cooled and rolled. Such pigmented films are available commercially in various thicknesses.

Antistatic agents useful in the hydrophobic antistatic layer of the invention include materials such as vanadium pentoxide, quaternary ammonium and phosphonium polymers, such as those disclosed in U.S. Pat. No. 4,070,189; polyaniline acid addition salts, such as those disclosed in U.S. Pat. No. 4,237,194; or others known in the art.

The hydrophobic antistatic layer employed in the invention may be prepared by coating an aqueous colloidal solution of an antistatic agent, such as vanadium pentoxide, preferably doped with silver as described in U.S. Pat. No. 4,203,769, the disclosure of which is hereby incorporated by reference. Low surface resistivities can be obtained with very low vanadium pentoxide coverages which results in low optical absorption and scattering losses. A polymer binder, such as poly(acrylonitrile-co-vinylidene chloride-co-acrylic acid) is preferably employed in the layer to improve integrity of the layer and to improve adhesion to a subbing layer. The weight ratio of polymer binder to antistatic agent can range from about 1:5 to 200:1, but preferably from about 1:1 to 10:1. The antistatic coating formulation may also contain a wetting aid to improve coatability. The hydrophobic antistatic layer of the invention may be present in any amount which is effective for the intended purpose. Typically, the antistatic layer is coated at a dry coverage of from about 0.001 to 0.2 g/m$^2$. Other materials may be used but they should have a integral resistivity of less than $5\times10^{10}$ ohms/square preferably $1\times10^{10}$ ohms/square. They should also be transparent, have little or no color, and adhere well to the oriented polymeric film.

In a preferred embodiment of the invention, the hydrophobic overcoat layer contains a binder and a matting agent which is dispersed in the binder in an amount sufficient to provide the desired surface roughness. A wide variety of polymers may be used for the binder of the overcoat layer. Such a polymer should be transparent, colorless, and have a glass transition temperature of at least 50° C., preferably greater than 100° C. In addition, the polymer in this overcoat layer must be compatible with adhesives which may be used in a lamination process, such as hydrophobic resins which are organic solvent-coated adhesives activated by heat and pressure. The bond formed with the adhesive must be greater than the cohesive strength of the oriented polymeric film. A preferred binder polymer employed in the invention is poly(methyl methacrylate) coated from solvent as described in U.S. Pat. No. 5,310,640, the disclosure of which is hereby incorporated by reference.

In the hydrophobic overcoat layer, either inorganic or organic matting agents can be used. Examples of organic matting agents include particles, often in the form of beads, of polymers such as polymeric esters of acrylic and methacrylic acid, e.g., poly(methyl-methacrylate), styrene polymers and copolymers, and the like. Examples of inorganic matting agents include particles of glass, silicon dioxide, titanium dioxide, aluminum oxide, barium sulfate and the like. Other matting agents are described in U.S. Pat. Nos. 3,411,907 and 3,754,924, the disclosures of which am hereby incorporated by reference. In a preferred embodiment of the invention, the matte particles are beads of poly(methyl-methacrylate-co-ethylene glycol dimethacrylate).

In a preferred embodiment, the hydrophobic overcoat layer has a surface roughness such that the Roughness Average (Ra) value is greater than 0.8, preferably greater than 1.2, and most preferably greater than 1.5. The concentration of the matte particles required to give the desired roughness depends on the mean diameter of the particles and the amount of binder used. Preferred particles are those with a mean diameter of from about 1 to 15 μm, preferably from 2 to 8 μm. The matte particles are generally employed at a concentration of about 0.001 to about 0.1 g/m$^2$.

The oriented polymeric film located on at least one, and preferably on both, outermost sides of the ID card stock of the invention can be, for example, polycarbonates, polyesters such as poly(ethylene naphthalate) and poly(ethylene terephthalate) (PET), polyolefins, polyamides, cellulose esters, polystyrene, polysulfonamides, polyethers, polyimides, poly(vinylidene fluoride), polyurethanes, poly (phenylene sulfides), polytetrafluoroethylene, polyacetals, polysulfonates, polyester ionomers, polyolefin ionomers, copolymers and mixtures of the above, etc. In a preferred embodiment of the invention, a synthetic linear polyester is employed. Such a material is well known to those skilled in the art and is obtained by condensing one or more dicarboxylic acids or their lower (up to 6 carbon atoms) diesters, e.g., terephthalic acid, isophthalic acid, phthalic acid, 2,5-, 2,6- or 2,7-naphthalenedicarboxylic acid, succinic acid, sebacic acid, adipic acid, azelaic acid, 4,4'-diphenyldicarboxylic acid, hexahydroterephthalic acid or 2-bis-p-carboxyphenoxyethane (optionally with a monocarboxylic acid, such as pivalic acid), the corresponding dicarboxylic acid dialkyl ester or lower alkyl ester with one or more glycols, e.g., ethylene glycol, 1,3-propanediol, 1,4-butanediol, neopentyl glycol and 1,4-cyclohexanedimethanol. In a preferred embodiment, the polyester polymer is obtained by condensing terephthalic acid or 2,6-naphthalenedicarboxylic acid or their dimethyl esters with ethylene glycol. In another preferred embodiment, the polymer is PET. The PET film prepared from the above-described composition must be oriented. In a preferred embodiment, the PET film is biaxially-oriented. Such a process is described in many patents, such as GB 838,708, the disclosure of which is hereby incorporated by reference. These techniques are well known to those skilled in the art.

The thickness of the oriented polymeric film employed in the invention can be, for example, 19 μm (0.75 mils) to 178 μm (7 mils).

The oriented polymeric film employed in the invention may employ an undercoat or a primer layer on one or both sides to promote adhesion of subsequently coated layers. Undercoat layers which can be used are described in U.S. Pat. Nos. 2,627,088; 2,698,235; 2,698,240; 2,943,937; 3,143,421; 3,201,249; 3,271,178; and 3,501,301, the disclosures of which are hereby incorporated by reference. A preferred material is poly(acrylonitrile-co-vinylidene chloride-co-acrylic acid).

The first step in the construction of a preferred composite ID card of the invention is the coating on a subbed polymeric support, such as PET, of the antistatic layer and its hydrophobic protective overcoat. With the antistatic layer and overcoat layers in place, the dye-receiver layers are coated from organic solvents onto the other side of the PET at high speeds without danger of explosion in the coating dryers caused by discharge of static electricity. Coating defects caused by static charging are also minimized.

The next step is the coating of an adhesive from an organic solvent over the hydrophobic protective layer of the antistatic backing layer. The antistatic layer is effective in this coating operation for the reasons stated above, and also functions to minimize attraction of dust which can interfere with good adhesion in the subsequent lamination process.

The dye-receiver component film is then glued to both sides of a white amorphous polyester core by attaching the side bearing the antistatic layer and overcoat layer to the core by means of an adhesive. Rectangular pieces of the components are placed between metal plates in a press and heat and pressure are applied to activate the adhesive and effect the gluing together of the card components. After removal from the press, the cards are die cut to the appropriate size for ID cards. The antistatic layer bonds so well to the resin used as the adhesive that cohesive failure occurred in the biaxially oriented polyester rather than adhesive failure between the backing and the adhesive.

Receiving layer polymers employed in the invention include polycarbonates, polyurethanes, polyesters, polyvinyl chlorides, poly(styrene-co-acrylonitrile), polycaprolactone or any other receiver polymer or mixtures thereof. In a preferred embodiment, the receiving layer is a dye image-receiving layer which comprises a polycarbonate. Preferred polycarbonates include bisphenol-A polycarbonates having a number average molecular weight of at least about 25,000. Examples of such polycarbonates include General Electric LEXAN® Polycarbonate Resin, Bayer AG MACROLON 5700®, and the polycarbonates disclosed in U.S. Pat. No. 4,927,803, the disclosure of which is incorporated by reference.

The dye image-receiving layer employed in the invention may be present in any amount which is effective for its intended purposes. In general, good results have been obtained at a receiver layer concentration of from about 1 to about 10 $g/m^2$, preferably from about 0.1 to about 1 $g/m^2$.

Between the dye image-receiving layer and the primed polyester film may be placed other layers such as a compliant or "cushion" layer as disclosed in U.S. Pat. No. 4,734,396, the disclosure of which is hereby incorporated by reference. The function of this layer is to reduce dropouts in the printing process caused by dirt and dust.

As described above, the outer oriented polymeric film or films used in the invention, such as PET, may be attached to the polymeric core substrate by extrusion, lamination, extrusion lamination, cold roll lamination, adhesive, etc. If an adhesive is to be used, it is dictated by the nature of the layers on the PET side opposite the dye image-receiver side as well as the material comprising the polymeric core substrate. This adhesive layer can be formed by use of conventional adhesives of the aqueous solution type, emulsion type, solvent type, solvent-less type, solid type, or those in the forth of films, tape or webs. The adhesive can be applied to the polymeric core substrate or to the back side layers of the PET film or to both but is preferably only applied to the PET film. The coated adhesive must allow winding and storage of the PET film at moderate temperatures without occurrence of blocking.

Dye-donor elements that are used with the ID card dye-receiving element of the invention conventionally comprise a support having thereon a dye-containing layer. Any dye can be used in the dye-donor element employed in the invention provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving layer on the ID card as described above to form the dye transfer image.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from dye-donor elements to the ID card receiving elements of the invention are available commercially. There can be employed, for example, a Fujitsu Thermal Head (FTP-040 MCS001), a TDK Thermal Head F415 HH7-1089, Kyocera KBE-57-12MGL2 Thermal Print Head or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element as described above, and (b) an ID card dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner. If the ID card stock has dye-receiving layers on both sides, the thermal printing process can then be applied to both sides of the cards.

After the card is thermally imaged, a transparent protective layer can be formed on the surface of the image-receiving layer if desired. This can be done by use of a dye-donor element which includes an additional non-dye patch comprising a transferable protection layer as disclosed in U.S. Pat. Nos. 5,332,713 and 5,387,573, the disclosures of which are incorporated by reference. A protective layer applied in this manner provides protection against image deterioration due to exposure to light, common chemicals, such as grease and oil from fingerprints, and plasticizers often found in items made with poly(vinyl chloride) such as wallets.

A clear, protective layer of equal or greater thickness than that applied from the dye-donor may also be applied to the card using a laminator with heat and pressure. Preferably this protective layer is transferred from a carrier film either in-line or off-line from the thermal printer using a hot roll laminator. Protective layer materials employed are clear thermoplastic polymers whose exact composition is dictated by the ability to adhere to the dye image-receiver layer and to provide the desired, specific protective properties. The protective layer must not degrade the image nor affect image stability to heat and light. Such layer may also incorporate other materials, such as ultraviolet light absorbers. The protective layer may also incorporate security devices such as holographic images.

The following example is provided to further illustrate the invention.

EXAMPLE

A dye-receiver used for a composite card stock of the invention was prepared in the following manner:

On both sides of a 178 μm thick, transparent, biaxially-oriented PET film was coated a subbing layer of poly (acrylonitrile-co-vinylidene chloride-co-acrylic acid) (14:79:7 wt. ratio) (0.05 g/m$^2$) and DC-1248 surfactant (0.016 g/m$^2$) (Dow Corning Corp.) coated from methyl ethyl ketone. On one side of the subbed PET were coated the following layers:

1) a compliant layer of a mixture of poly(n-butyl acrylate-co-acrylic acid) (50:50 wt. ratio) (8.1 g/m$^2$), 1,4-butanediol diglycidyl ether (0.57 g/m$^2$), tributylamine (0.32 g/m$^2$), and Fluorad® FC-431 perfluoroamido surfactant (3M Corp.) (0.016 g/m$^2$) from acetone/water solvent;
2) a subbing layer of a mixture of poly(acrylonitrile-co-vinylidene chloride-co-acrylic acid) (14:79:7 wt. ratio) (0.54 g/m$^2$), and DC-1248 surfactant (0.016 g/m$^2$) (Dow Corning Corp.) coated from methyl ethyl ketone;
3) a dye image-receiving layer of a mixture of Makrolon® KL3-1013 polycarbonate, (Bayer AG), (1.78 g/m$^2$), Lexan® 141-112 poly-carbonate (General Electric) (1.45 g/m$^2$), dibutyl phthalate, (0.32 g/m$^2$), diphenyl phthalate, (0.32 g/m$^2$), and Fluorad ® FC-431 (0.011g/m$^2$) dissolved in methylene chloride; and
4) an overcoat layer comprising a mixture of a random terpolymer polycarbonate (50 mole % bisphenol A, 49 mole % diethylene glycol, and 1 mole % 2,500 m.w. polydimethylsiloxane block units) (0.22 g/m$^2$), Fluorad® FC-431 and Dow-Corning 510 Silicone Fluid (a mixture of dimethyl and methyl phenyl siloxanes) (0.005 g/m$^2$) dissolved in methylene chloride.

On the opposite side of the subbed support were coated the following layers:

1) an antistatic layer coated from an aqueous formulation of 0.025 wt. % silver-doped vanadium pentoxide, 0.025 wt. % of poly(acrylonitrile-co-vinylidene chloride-co-acrylic acid) and 0.01 wt. % OLIN 10G surfactant (p-nonyl phenoxy polyglycidol available from OLIN Corp.) to give a dry weight of about 0.006 g/m$^2$; and
2) an overcoat layer of Elvacite® 2041 (poly(methyl methacrylate) from DuPont Co.) (1.08 g/m$^2$), matte beads (3–4 μm) of poly(methyl methacrylate-co-ethylene glycol methacrylate) (0.025 g/m$^2$), and Fluorad® FC-431 (a surfactant available from 3M Corp.) coated from methylene chloride. Over the protective coating was applied a heat- and pressure-activated, thermoplastic resin-type adhesive of a terpolymer of vinyl chloride, vinyl acetate and maleic acid (4.1 g/m$^2$) coated from solvent.

Control

A dye-receiver similar to the one described above was prepared for a control card stock with the antistatic layer and its overcoat layer being replaced by a single antistatic layer as disclosed in U.S. Pat. No. 5,198,408 coated from water as follows:

| Control Antistatic Layer | |
|---|---|
| Colloids 7190-25 (fully hydrolyzed polyvinyl alcohol) (Colloids Industries) | 0.11 g/m$^2$ |
| Ludox ® AM alumina (DuPont Corp.) 0.014 μm diameter | 0.046 g/m$^2$ |
| polystyrene beads crosslinked with m- and p-divinylbenzene | 0.003 g/m$^2$ |

-continued

| Control Antistatic Layer | |
|---|---|
| of average diameter of 4 μm | |
| Poly(ethylene oxide) #136D (MW 900,000) (Scientific Polymer Products) | 0.032 g/m² |
| Triton ® X-200E (Rohm and Haas Inc.) | 0.002 g/m² |
| APG-225 (Henkel Corp.) | 0.002 g/m² |
| KCl (antistatic agent) | 0.008 g/m² |

The control dye-receiver with the antistatic layer described above was then coated with adhesive as in the invention dye-receiver.

A wide coating of the PET film described above was trimmed at the edges and the edges were marked as A and B. The coating was then slit up along its center in the machine direction into two slits each (610 mm) in width. Rectangular pieces were then cut (826 mm) in length from the slits, keeping those pieces having edge A separate from those having edge B.

A piece of the PET film bearing edge A was placed with the adhesive side down on a piece of white, pigmented, amorphous polyester core slightly smaller in size and about 356 μm thick. The amorphous polyester was EASTAR® PETG 6763 (Eastman Chemical Co.). The white pigment in the polyester core was $TiO_2$. A piece of the PET film bearing edge B was placed on the opposite side of the polyester core, with the adhesive side in contact with the polyester core, and edge B was placed so that edge A was superimposed over it. The white polyester sheet was printed before forming the composite to provide marks for controlling the die cutting of the cards from the glued composite.

The composite and metal plates enclosing the composite were placed in a platen press, then heat (about 110° C.) and pressure (about 17 bar) were applied for about 18 minutes, followed by cooling to produce an ID card.

The finished ID cards were then tested to compare the effect of the antistatic backing layers for adhesion of the dye-receiver component to the polyester core. A steel pin 0.86 mm in diameter with a sharp point was inserted into the core of the card from the edge of the card.

In the Control test card, as the pin was pushed in, delamination readily occurred such that the dye-receiver component could be readily peeled off from the adhesive on the polyester core. With the Invention card, insertion of the pin did not cause delamination. A small tear in the PET support of the dye-receiver was obtained which, when grasped with pliers, produced only further tearing of the PET support. This showed that the bond between the polyester core and the backing of the dye-receiver was stronger than the cohesive strength of the PET support of the dye-receiver component.

The force required to peel off the dye-receiver component from the card at a 180 degree angle for the Control was also determined. Delamination was started for a distance of about 1.3 cm in the direction of the longer axis. Then paper masking tape, 2.5 cm wide, was attached to the card (85.7×54 mm) and to a Chattilon DG10 force meter which was moved by a constant speed, motor driven platen at 0.67 mm/sec. Using the Invention card, the peel could not be started with a knife and only the force of the tape peeling off from the card could be measured. The peel force in Newtons/meter (N/m) was measured as follows:

TABLE I

| ID Card | Delamination | PET Tearing | Peel Strength (N/m) |
|---|---|---|---|
| Invention | No | Yes | >106 * |
| Control | Yes, easily | No | 8.2 |

* Card did not deaminate. Force measured was that at point where tape peeled off from Invention card.

The above results show that the ID card of the invention is superior to the Control ID card for adhesion in the lamination of the dye-receiver component to the core of the card.

The Status A reflection densities of the cards were also measured with an X-rite 820 reflection densitometer as follows:

TABLE 2

| | Status A Reflection Density | | | |
|---|---|---|---|---|
| ID Card | Neutral | Red | Green | Blue |
| Invention | 0.11 | 0.09 | 0.12 | 0.16 |
| Control | 0.12 | 0.10 | 0.13 | 0.15 |

The above results show that the Invention ID card and the Control ID card have approximately the same reflection density. Thus, the antistatic backing layer of the Invention ID card has no detrimental effect on reflection density as compared to the Control.

The invention has been described in detail with particular reference to preferred embodiments thereof, but it will be understood that variations and modifications can be effected within the spirit and scope of the invention.

What is claimed is:

1. A process of forming a dye transfer image comprising imagewise-heating a dye-donor element comprising a support having thereon a dye layer and transferring a dye image to a dye-receiving element to form said dye transfer image, said dye-receiving element comprising an identification card stock comprising a polymeric core substrate having on at least one side thereof the following layers in order: a hydrophobic antistatic layer, an oriented polymeric film, and an image-receiving layer.

2. The process of claim 1 wherein said oriented polymeric film is biaxially-oriented poly(ethylene terephthalate) and which is located on each side of said polymeric core.

3. The process of claim 1 wherein an adhesive layer and a hydrophobic overcoat layer are located between said polymeric core substrate and said hydrophobic antistatic layer, said adhesive layer being located on said polymeric core substrate.

4. The process of claim 3 wherein said hydrophobic overcoat layer comprises matte particles and a hydrophobic binder which is transparent and has a glass transition temperature of at least 50° C.

5. The process of claim 4 wherein said hydrophobic binder is poly(methyl methacrylate).

6. The process of claim 1 wherein said hydrophobic antistatic layer comprises silver doped vanadium pentoxide and a binder of poly(acrylonitrile-co-vinylidene chloride-co-acrylic acid).

7. A thermal dye transfer assemblage comprising:

(a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer, wherein said dye-receiving element comprises an identification card stock comprising a polymeric core substrate having on at least one side thereof the following layers in order: a hydrophobic antistatic layer, an oriented polymeric film, and an image-receiving layer.

8. The assemblage of claim 7 wherein said oriented polymeric film is biaxially-oriented poly(ethylene terephthalate) and which is located on each side of said polymeric core.

9. The assemblage of claim 7 wherein an adhesive layer and a hydrophobic overcoat layer are located between said polymeric core substrate and said hydrophobic antistatic layer, said adhesive layer being located on said polymeric core substrate.

10. The assemblage of claim 9 wherein said hydrophobic overcoat layer comprises matte particles and a hydrophobic binder which is transparent and has a glass transition temperature of at least 50° C.

11. The assemblage of claim 10 wherein said hydrophobic binder is poly(methyl methacrylate).

12. The assemblage of claim 7 wherein said hydrophobic antistatic layer comprises silver doped vanadium pentoxide and a binder of poly(acrylonitrile-co-vinylidene chloride-co-acrylic acid).

13. An identification card stock comprising a polymeric core substrate having on at least one side thereof the following layers in order: a hydrophobic antistatic layer, an oriented polymeric film, and an image-receiving layer.

14. The identification card stock of claim 13 wherein said oriented polymeric film is biaxially-oriented poly(ethylene terephthalate) and which is located on each side of said polymeric core.

15. The identification card stock of claim 13 wherein an adhesive layer and a hydrophobic overcoat layer are located between said polymeric core substrate and said hydrophobic antistatic layer, said adhesive layer being located on said polymeric core substrate.

16. The identification card stock of claim 15 wherein said hydrophobic overcoat layer comprises matte particles and a hydrophobic binder which is transparent and has a glass transition temperature of at least 50° C.

17. The identification card stock of claim 16 wherein said hydrophobic binder is poly(methyl methacrylate).

18. The identification card stock of claim 13 wherein said hydrophobic antistatic layer comprises silver doped vanadium pentoxide and a binder of poly(acrylonitrile-co-vinylidene chloride-co-acrylic acid).

19. The identification card stock of claim 13 wherein said image-receiving layer contains a thermally-transferred dye image.

* * * * *